US005197427A

United States Patent [19]

Masuda et al.

[11] Patent Number: 5,197,427

[45] Date of Patent: Mar. 30, 1993

[54] ACCESSORY DRIVE DEVICE FOR AN INTERNAL COMBUSTION ENGINE

[75] Inventors: Shunji Masuda, Hiroshima; Tatsuya Uesugi, Higashi-Hiroshima; Toshimitsu Tanaka, Ohtake; Naoyuki Yamagata, Hiroshima, all of Japan

[73] Assignee: Mazda Motor Corporation, Hiroshima, Japan

[21] Appl. No.: 800,978

[22] Filed: Dec. 2, 1991

[30] Foreign Application Priority Data

Nov. 30, 1990 [JP] Japan ..... 2-340086

[51] Int. Cl.[5] ..... F02B 77/00

[52] U.S. Cl. ..... 123/198 R; 123/559.1

[58] Field of Search ..... 123/55 VF, 55 VS, 55 VE, 123/195 A, 195 C, 198 R, 559.1

[56] References Cited

U.S. PATENT DOCUMENTS

| | | | |
|---|---|---|---|
| 4,643,143 | 2/1987 | Uchiyama et al. | 123/90.27 |
| 4,957,077 | 9/1990 | Okitsu et al. | 123/90.31 |
| 5,022,365 | 6/1991 | Nariyama | 123/90.27 |
| 5,085,199 | 2/1992 | Sado et al. | 123/559.1 |

FOREIGN PATENT DOCUMENTS

| | | |
|---|---|---|
| 0095250 | 11/1983 | European Pat. Off. . |
| 3342821 | 6/1985 | Fed. Rep. of Germany . |
| 3907039 | 5/1990 | Fed. Rep. of Germany . |
| 62-71340 | 5/1987 | Japan . |
| 1-193032 | 8/1989 | Japan . |

OTHER PUBLICATIONS

Patent Abstracts of Japan—vol. 13, No. 485 (M-887) (3833) Nov. 6, 1989.

*Primary Examiner*—Noah P. Kamen
*Attorney, Agent, or Firm*—Keck, Mahin & Cate

[57] ABSTRACT

In a V-type engine with two bore-offset banks opposed to one another at a predetermined angle, an accessory mechanism is provided between the two banks. A drive belt for the accessory mechanism is disposed on the side of one of the banks which is recessed inwardly due to the bore offset. In another embodiment, the accessory mechanism is a supercharger driven by a balancing shaft which, in turn, is driven by the crank shaft. In yet another embodiment, the V-type engine has a separate timing belt for each bank, that is, a first timing belt for the bank which is recessed inward because of the bore offset, and a second timing belt for the bank which juts out because of the bore offset. A drive belt is provided for driving the supercharger. The belts are arranged in the following order from the inside outward: the second timing belt, the first timing belt and the accessory belt.

21 Claims, 4 Drawing Sheets

ACCESSORY DRIVE DEVICE FOR AN INTERNAL COMBUSTION ENGINE

BACKGROUND OF THE INVENTION

The present invention relates to an accessory drive device for an internal combustion engine.

DESCRIPTION OF THE RELATED ART

Generally, in automobile engines, various accessories such as superchargers, alternators and the like are attached to an engine. These accessories are driven by engine power (See, for example, Japanese Utility Model Public Disclosure (JPU) No. Sho 62-71340).

In recent years, the demand for making engines with accessories more compact has increased, and V-type engines have evolved to meet these demands.

In engines such as that disclosed in the above Japanese Utility Model Application, in order to prevent interference between the timing belt, used to drive the cam shaft via the crank shaft, and the various accessory drive belts for driving the accessories, it has been necessary to arrange the belts in line extending out from the engine. The amount that the belts jut out from the engine (the overhang) has thus become larger. This adversely affects the ability to make the engine compact. Specifically, in the case of an engine provided with a supercharger, because the supercharger belt is arranged in line with the timing belt and the belt of another accessory, the engine has even further problems with large overhang.

SUMMARY OF THE INVENTION

It is, therefore, an object of the present invention to overcome the above problems with the prior art and to provide for a more compact engine design.

The above object is obtained according to the present invention by providing a V-type engine with two bore-offset banks opposed to one another at a predetermined angle in which an accessory mechanism is provided between the two banks. A drive belt for the accessory mechanism is disposed on the side of one of the banks which is recessed inwardly due to the bore offset.

In accordance with another embodiment of the present invention, the accessory mechanism is a supercharger driven by a balancing shaft which in turn is driven by the crank shaft.

In yet another embodiment of the present invention, the V-type engine has a separate timing belt for each bank. More particularly, a first timing belt is provided for the bank which is recessed inward because of the bore offset, and a second timing belt is provided for the bank which juts out because of the bore offset. A drive belt is provided for driving the supercharger. In this embodiment the belts are arranged in the following order from the inside outward: the second timing belt, the first timing belt and the accessory belt.

The first two embodiments of the present invention function as follows.

The belt which drives the accessory mechanism (e.g., a supercharger) positioned between the banks is arranged to be on the side of the bank which is recessed inwardly due to the bore offset. Because of this arrangement, the amount that the accessory drive belt (e.g., supercharger drive belt) juts forward is reduced, and the overhang can be kept small.

The third embodiment of the invention, by use of the above means, functions as follows.

The drive belt for driving the supercharger, the timing belt for the bank which juts out, and the timing belt for the bank which is recessed inwardly because of the bore offset are arranged, in that order, from the inside outward. Because of this arrangement, the material of the supercharger drive belt can be made thicker.

In the first embodiment, the accessory mechanism is disposed between the banks of a V-type engine having two bore offset banks opposed to one another at a predetermined angle. Because the belt for driving the accessory mechanism is arranged on the side of the bank which is recessed inwardly due to the bore offset, and the amount that the belt juts forward is kept to a minimum, it is possible to keep the overhang from the engine small, and to achieve a desirable reduction in the axial dimensions of the engine unit, i.e., to make the engine more compact.

In the second embodiment of the present invention, the engine accessory is a supercharger and is driven by a balancing shaft which, in turn, is driven by a crank shaft. Because the belt for driving the supercharger juts out to a lesser extent, it is possible to keep the overhang from the engine small and to reduce the axial dimensions of the engine, i.e., to make the engine more compact. Because the supercharger, which requires a great deal of torque, is driven by a balancing shaft whose axial end does not oscillate as does the crank shaft, the supercharger can be smoothly driven.

In the third embodiment of the invention, there is a separate timing belt for each bank of the V-type engine, and the belts are arranged in the order, from the inside outwardly, of the drive belt for the supercharger, the timing belt for the bank on the side which juts out due to the bore offset, and the timing belt for the bank on the side which is recessed inwardly due to the bore offset. This arrangement, because it allows the material of the supercharger drive belt to be thicker, has the advantage that the supercharger can be run more smoothly.

The preferred embodiments of the invention will now be further explained with reference to the attached drawings in which like parts are referred to with like reference numerals.

Further objects, features and advantages of the present invention will be apparent from the Description of Preferred Embodiments which follows, when considered together with the attached drawings.

DESCRIPTION OF THE PREFERRED EMBODIMENTS

Figure 1:
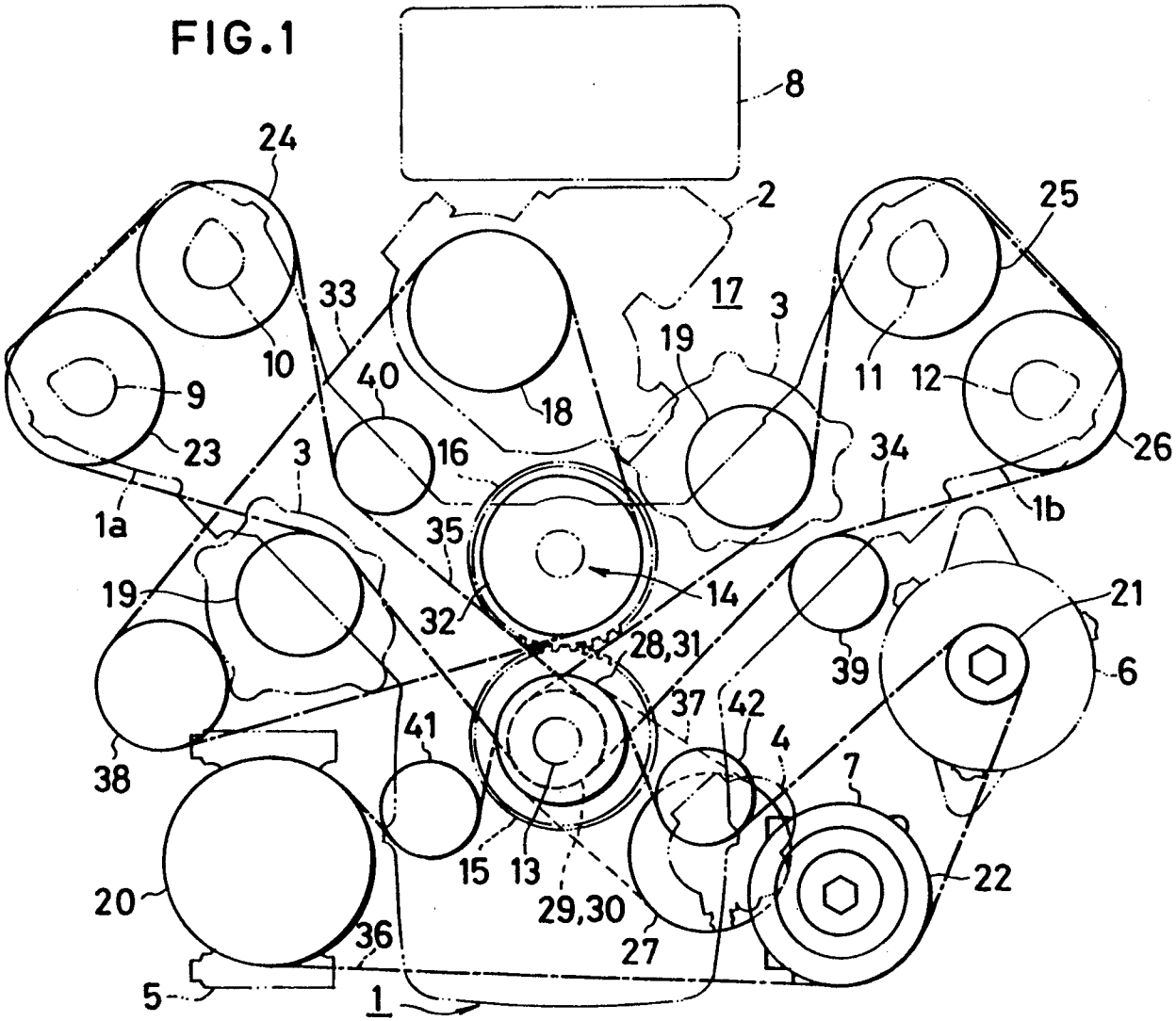
FIG. 1 shows a plan view from the front of a first internal combustion engine incorporating the accessory drive device according to the present invention.

The invention will now be further explained with reference to the drawings in which like reference numerals represent like parts.

The First Engine Incorporating the Invention

Figure 2:
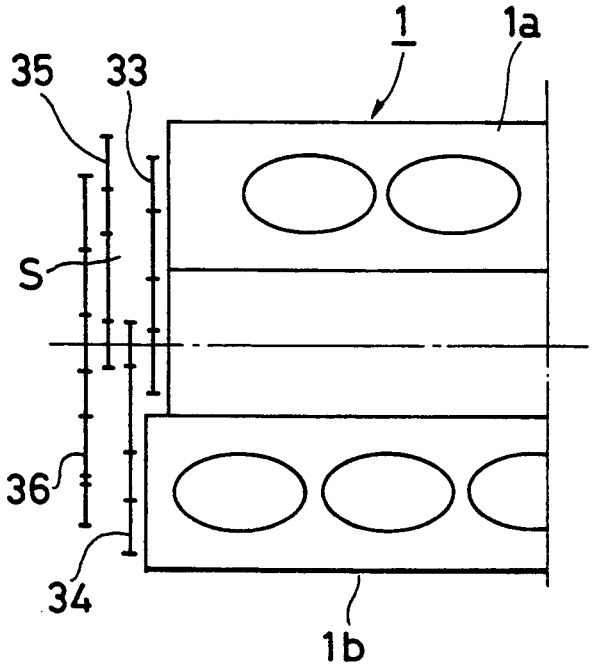
FIG. 2 shows a schematic, top view of the first engine in order to better illustrate the position of the belts.

A first internal combustion engine incorporating a drive unit device for an accessory mechanism according to the present invention is shown in FIGS. 1 and 2.

In this embodiment, the internal combustion engine 1 is a V-type, six cylinder engine. The banks 1*a*, 1*b* of the engine 1 define an angle of 90° to one another. One of the banks, bank 1*a*, is recessed inwardly from the other bank 1*b* due to the bore offset of the engine. Therefore, bank 1*b* juts out from the engine relative to bank 1*a*.

Attached to the engine 1, and driven off the power of engine 1 are supercharger 2, water pumps 3, oil pump 4, air conditioner compressor 5, alternator 6, and power steering unit 7. Reference numeral 8 refers to a water cooling intercooler, and 9 through 12 are cam shafts. Above crank shaft 13 in engine 1, a balancing shaft 14 is provided which rotates in synchronism with crank shaft 13. Shafts 13 and 14 are connected by means of counter gears 15, 16.

Water pumps 3 are disposed to the left and right of balancing shaft 14 and correspond to each of the banks 1*a*, 1*b*. In this embodiment, banks 1*a*, 1*b* are each supplied with cooled water by a corresponding water pump 3. Due to this structure, the amount of cooled water circulated to the banks 1*a*, 1*b* is designed to be equivalent.

The supercharger 2 is disposed in the space 17 formed between the two banks 1*a*, 1*b*. By means of such a structure, the space between the banks 1*a*, 1*b* can be effectively used, and the supercharger 2 can be designed to be of increased size.

The oil pump 4, air conditioner compressor 5, alternator 6 and power steering unit 7 are disposed gathered together in the lower part of the engine. In this embodiment, oil pump 4 is positioned in the oil pan portion in the engine 1.

Torque transmission pulleys 18 through 26 are respectively attached to supercharger 2, water pumps 3, 3, air conditioner compressor 5, alternator 6, power steering unit 7 and cam shafts 9 through 12. A drive power transmission sprocket 27 is provided attached to oil pump 4.

Attached to the crankshaft 13 are large diameter pulley 28, two small diameter pulleys 29, 30 and sprocket 31. Power transmission pulley 32 is attached to the balancing shaft 14.

The pulley 32 for the balancing shaft and supercharger pulley 18 are connected so that power may be transmitted by means of the supercharger drive belt 33.

The small diameter pulley 29 for the crank shaft is connected with the water pump pulley 19 for the water pump 3 of bank 1*b*, and pulleys 25, 26 for the cam shafts so that power can be transmitted by the first timing belt 34.

The small diameter pulley 30 for the crank shaft is connected with the water pump pulley 19 for the water pump 3 of bank 1*a*, and pulleys 23, 24 for the cam shafts so that power can be transmitted by the second timing belt 35. In this embodiment, the timing belts for each bank are separate. Here, the pulleys 19, 19 for the water pumps 3 even function as idlers. The large diameter pulley 28 for the crank shaft, the compressor pulley 20, alternator pulley 21, and power steering pulley 22 are connected so that power may be transmitted by means of accessory drive belt 36. In this embodiment, sprocket 31 for the crank shaft and oil pump sprocket 27 are connected so that power may be transmitted by chain 37.

In FIG. 1, reference numeral 38 refers to a fixed idler over which supercharger drive belt 33 passes, 39 refers to a fixed idler over which first timing belt 34 passes, 40 refers to an idler over which second timing belt 35 passes, 41 refers to a fixed idler over which accessory drive belt 36 passes, and 42 refers to an auto-tensioning idler over which accessory drive belt 36 passes. In the present embodiment, fixed idler 38 is disposed at the bottom part of one bank 1*a* of the engine 1, and as a consequence, supercharger drive belt 33 is positioned on the inside, at the bank 1*a* which is recessed inwardly due to the bore offset. As a result, the degree to which supercharger drive belt 33 juts out from the engine 1 is kept small.

As can be seen from FIG. 2, the supercharger drive belt 33 disposed on the side of the bank 1*a* which is recessed inwardly due to the bore offset, the first timing belt 34 arranged on the side of the bank 1*b* which juts out due to the bore offset, the second timing belt 35 for bank 1*a* and the accessory drive belt 36 are arranged in that order from the inside outward.

Because of the above structure, in the present embodiment, the amount that juts out from the engine 1 can be reduced. That is, the overhang of the overall system comprising a drive system driven by the supercharger drive belt 33, a system driven by the first timing belt 34, a system driven by the second timing belt 35, and a system driven by accessory drive belt 33, is made smaller. Thus, the axial dimensions of the engine unit can be reduced.

In between the drive system driven by the supercharger drive belt 33 and the system driven by the second timing belt 35, a relative space S is formed corresponding to the first timing belt 34. Belt 34 extends forward of bank 1*b* in a direction opposite to the second timing belt 35. As a result, even if the material of the supercharger drive belt 33 is made bigger, there is no fear of interference with other belts, such as the second timing belt 35. Accordingly, one can make a supercharger 2 with large driving torque run smoothly.

The first and second timing belts 34, 35 are symmetrical with respect to the crank shaft 13. Moreover, an upward load is exerted by the timing belts 34, 35 with respect to the crank shaft on the one hand and a downward load is exerted by the accessory drive belt 36 on the other hand, so that the upward and downward load operating on the crank shaft balances out. This has the advantage of getting rid of the load burden on the crankshaft.

Although in this first engine, an embodiment is illustrated in which the accessory mechanism located between the two banks 1*a*, 1*b* is a supercharger, it is also possible to use another accessory mechanism.

Although this embodiment is constructed so that the supercharger 2 is driven by balancing shaft 14, it is also possible to drive the supercharger 2 by means of the crankshaft 13.

The Second Engine Incorporating the Invention

Figures 3, 4:
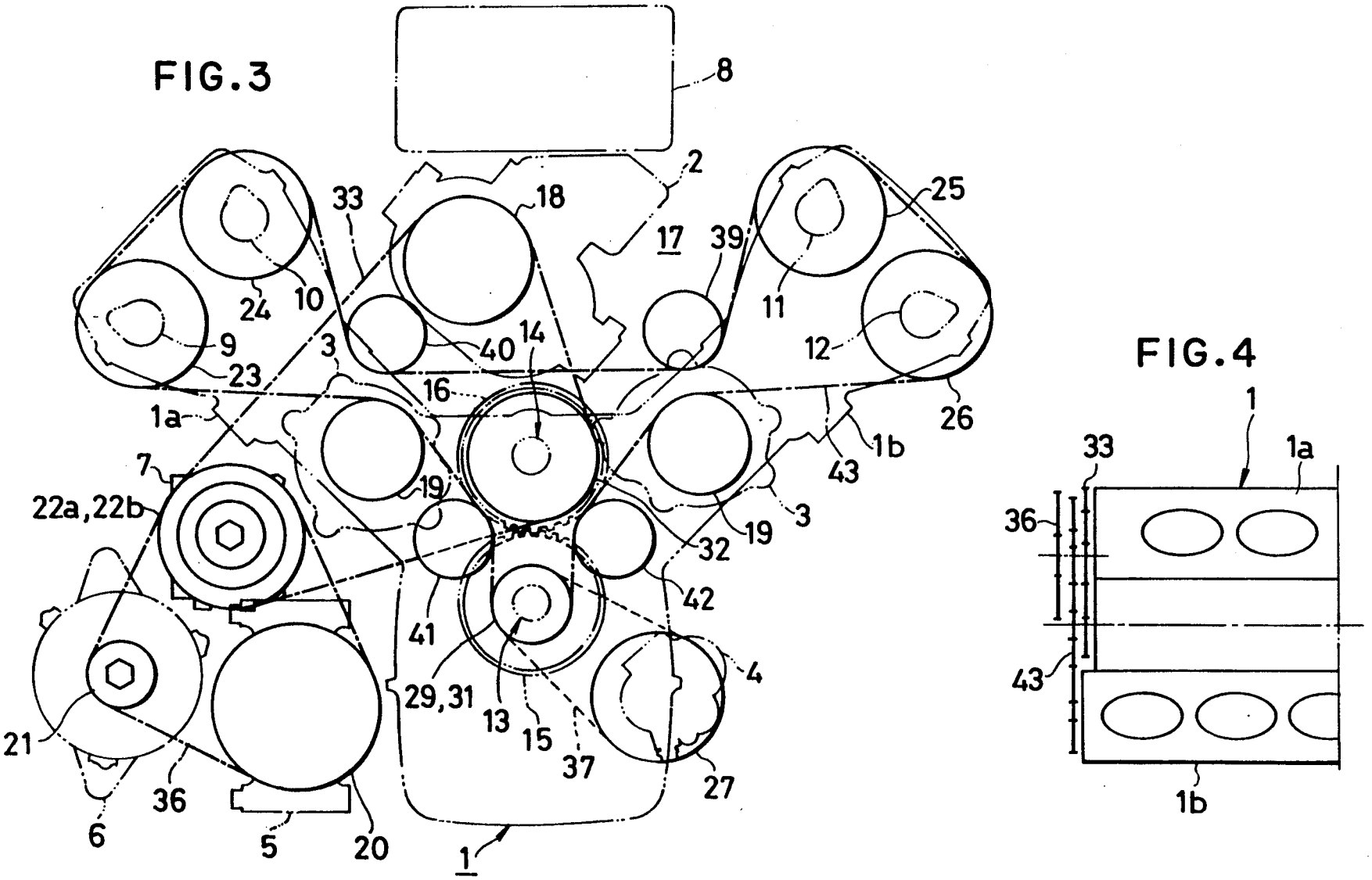
FIG. 3 shows plan view from the front of a second internal combustion engine incorporating the accessory drive device according to the present invention.
FIG. 4 shows a schematic, top view of the second engine in order to better illustrate the position of the belts.

FIGS. 3 and 4 show a second embodiment of the accessory drive device for an internal combustion engine according to the present invention.

In this embodiment, the power steering unit 7, alternator 6 and air conditioning compressor 5 are all gathered in the lower portion of engine 1 on the inwardly-recessed side of the bank 1*al*. Two power transmission pulleys 22*a*, 22*b* are provided in the power steering unit 7. Supercharger pulley 18, and power steering pulley 22*a* are connected by means of supercharger drive belt 33 so as to be able to transmit power from the balancing shaft 14. The power steering pulley 22*b* is connected with the compressor pulley 20 and the alternator pulley 21 so that power may be transmitted by accessory drive belt 36. As a result, in this embodiment, supercharger 2, power steering unit 7, alternator 6, and air conditioning compressor 5 are driven by balancing shaft 14.

In this embodiment, water pumps 3, 3, and cam shafts 9 through 12 are driven out of the crank shaft 13 by means of a single timing belt 43. Accordingly, a single power transmission pulley 29 and sprocket 31 are provided on the crank shaft 13. The additional structure of this embodiment is the same as the first embodiment and a detailed discussion is omitted.

By means of the above structure, even in this embodiment, the supercharger drive belt is disposed on the side of the bank 1*a* which is recessed inwardly due to the bore offset, and one can obtain a reduction in overhang from the engine.

The Engine Incorporating the Invention

Figure 5:
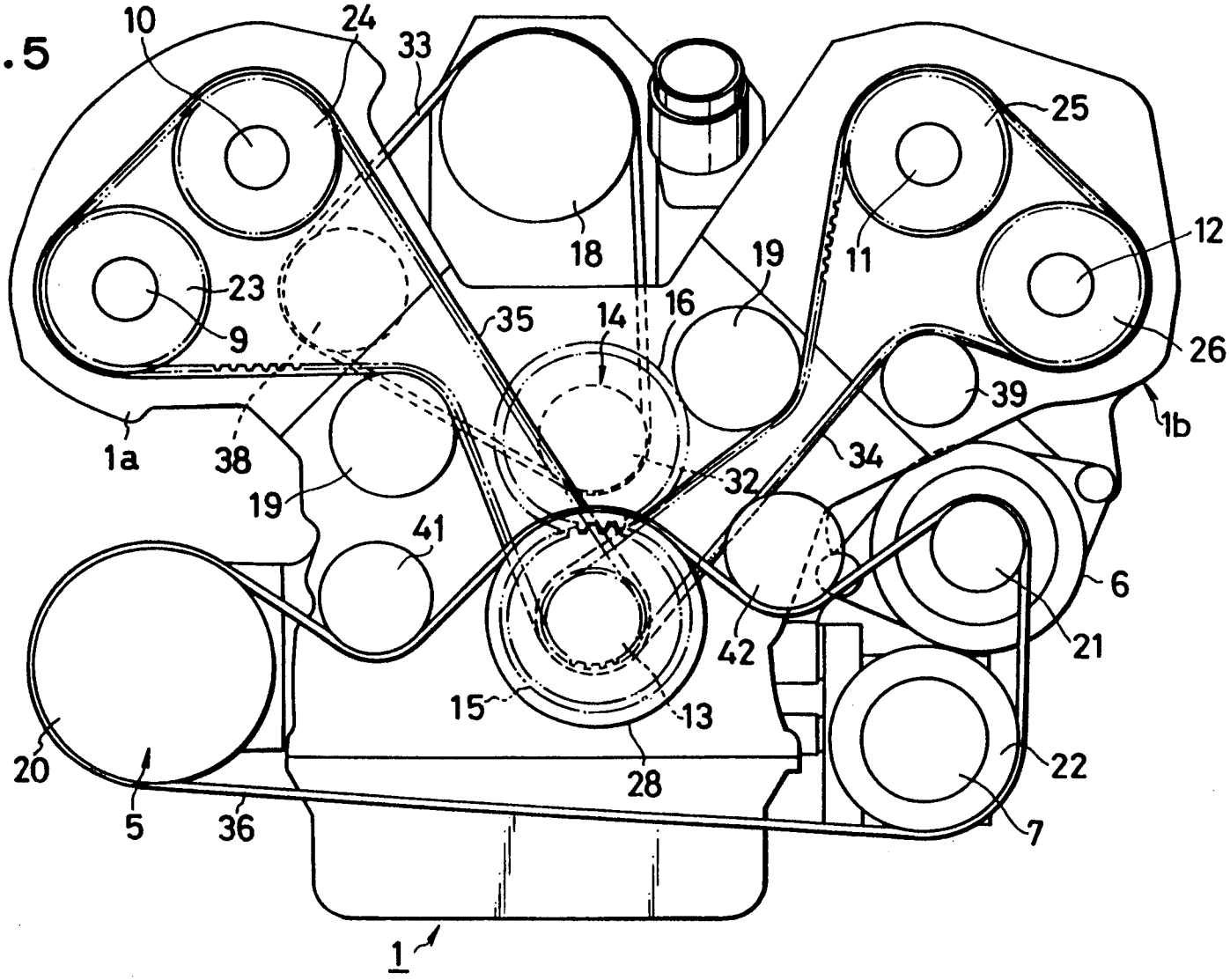
FIG. 5 is a front view similar to FIG. 1 but shows a third engine incorporating the present invention.

Referring to FIG. 5, there is shown a further modification of the present invention. In this embodiment, the fixed idler pulley 38 is arranged just inside of the cam shaft 9, 10 for the bank 1*a*. The length of the belt 33 can be made shorter than that of the structure of FIG. 1. A water pump pulley 19 is located closer to the inside with regard to the engine 1 than the structure of FIG. 1. This results in a greater bending angle, which improves power transmission because the belt 35 is engaged with the pulley 19 along a greater length.

Although the present invention has been illustrated by means of several preferred embodiments, one of ordinary skill in the art will recognize that modifications and improvements may be made while remaining within the spirit and scope of the present invention. The scope of the invention is determined solely by the appended claims.

What is claimed is:

1. In an internal combustion, V-type engine having a first bank and a second bank, wherein the second bank is opposed to the first bank at a predetermined angle, and wherein bores of the first bank are offset from bores of the second bank so that the first bank is recessed relative to the second bank, an accessory drive device comprising:

an accessory mechanism positioned in a space formed between the first bank and the second bank, and a drive belt for the accessory mechanism disposed on a side of the first bank which is recessed relative to the second bank.

2. A drive device according to claim 1, wherein the accessory mechanism is a supercharger, and wherein the supercharger is driven by a balancing shaft driven by a crank shaft.

3. A drive device according to claim 2, wherein the engine further comprises a timing belt for each of the first and second banks, and wherein the drive belt, the second bank timing belt and the first bank timing belt are arranged, in this order, outward from the first bank which is recessed relative to the second bank.

4. A drive device according to claim 3, wherein a small diameter pulley operably connected to the crank shaft is connected with a water pump pulley for the second bank and a second bank cam shaft pulley so that power is transmitted by the first bank timing belt.

5. A drive device according to claim 3, wherein a small diameter pulley operably connected to the crank shaft is connected with a water pump pulley for the first bank and a first bank cam shaft pulley so that power is transmitted by the second bank timing belt.

6. A drive device according to claim 3, wherein a second pulley for the crank shaft, a compressor pulley, an alternator pulley, and power steering pulley are connected so that power is transmitted by means of the drive belt.

7. A drive device according to claim 3, wherein a sprocket operably connected to the crank shaft and oil pump sprocket are connected so that power is transmitted by a chain.

8. A drive device according to claim 3, wherein a fixed idler over which the drive belt passes is provided.

9. A drive device according to claim 3, wherein a fixed idler over which the second bank timing belt passes is provided.

10. A drive device according to claim 3, wherein an idler over which the first bank timing belt passes is provided.

11. A drive device according to claim 3, wherein the first and second bank timing belts are symmetrical with respect to the crank shaft.

12. A drive device according to claim 3, wherein an upward load is exerted by the timing belts with respect to the crank shaft on the one hand and a downward load is exerted by the drive belt on the other hand so that the upward and downward loads operating on the crank shaft balance out.

13. A drive device according to claim 3, wherein a power steering unit, an alternator and an air conditioning compressor are all gathered in a lower portion engine outside of the first bank.

14. A drive device according to claim 13 and further comprising a power transmission pulley for transmitting power to the power steering unit.

15. A drive device according to claim 14, wherein a supercharger pulley for transmitting power to the supercharger and the power transmission pulley are connected by means of the drive belt so as to transmit power from the balancing shaft.

16. A drive device according to claim 15 and further comprising second power steering pulleys connected with a compressor pulley and an alternator pulley so that power is transmitted by the drive belt.

17. A drive device according to claim 3, and further comprising water pumps and cam shafts for the first and second banks, each water pump and cam shaft for the first bank and each water pump and cam shaft for the second bank being driven by the crank shaft by means of one of the first bank timing belt and the second bank timing belt.

18. A drive device according to claim 2, wherein the balancing shaft and the crank shaft are connected by means of counter gears.

19. A drive device according to claim 2, wherein water pumps are disposed to the left and right of the balancing shaft and correspond to each of the banks.

20. A drive device according to claim 1, wherein the first bank and the second bank define an angle of 90° relative to one another.

21. A drive device according to claim 1, wherein an oil pump, an air conditioner compressor, an alternator and a power steering unit are gathered together and disposed in the lower part of the engine.

* * * * *